US006050105A

United States Patent [19]

Keenan

[11] Patent Number: 6,050,105

[45] Date of Patent: Apr. 18, 2000

[54] APPARATUS AND METHOD FOR COMPRESSING A NITROGEN PRODUCT

[75] Inventor: Brian Anthony Keenan, New Malden, United Kingdom

[73] Assignee: The BOC Group plc, Windlesham, United Kingdom

[21] Appl. No.: 09/131,979

[22] Filed: Aug. 11, 1998

[30] Foreign Application Priority Data

Aug. 15, 1997 [GB] United Kingdom ..... 97 17350

[51] Int. Cl.[7] ..... F17C 1/00

[52] U.S. Cl. ..... 62/643; 60/39.12; 62/915

[58] Field of Search ..... 62/915, 643; 60/39.12

[56] References Cited

U.S. PATENT DOCUMENTS 3,394,555 7/1968 La Fluer ..... 62/915
3,731,495 5/1973 Coveney ..... 62/915
3,950,957 4/1976 Zakon ..... 62/915
4,785,621 11/1988 Alderson et al. ..... 60/39.12
5,081,845 1/1992 Allam et al. ..... 60/39.12
5,317,862 6/1994 Rathbone ..... 62/915
5,459,994 10/1995 Drnevich ..... 60/39.12

*Primary Examiner*—Ronald Capossela
*Attorney, Agent, or Firm*—Salvatore P. Pace

[57] ABSTRACT

An air separation plant includes a product nitrogen compressor, a gas turbine and a steam turbine. The gas turbine and the steam turbine are operatively associated with the product nitrogen compressor so as to be able to drive the product nitrogen compressor. The steam turbine has an inlet communicating with a steam generator adapted to recover heat from the gas turbine. The air separation plant also includes an air compressor which is typically similarly operatively associated with a gas turbine and a steam turbine. The steam turbine has an inlet communicating with a steam generator adapted to recover heat from the gas turbine.

6 Claims, 2 Drawing Sheets

APPARATUS AND METHOD FOR COMPRESSING A NITROGEN PRODUCT

BACKGROUND OF THE INVENTION

This invention relates to gas separation, in particular to an air separation plant.

An air separation plant is often provided with a product compressor in addition to one or more air compressors. In large plants producing more than 1000 tonnes per day of product, separation is normally performed by rectification.

U.S. Pat. No. 4,382,366 relates to an air separation plant which produces an oxygen product. An oxygen product compressor is directly driven by a steam turbine. A waste nitrogen stream containing sufficient oxygen to support combustion is taken from the rectification column in which the oxygen product is separated and is without further compression introduced into a chamber in which combustion of a fuel gas takes place. The resultant combustion products are expanded in a turbo-expander. The steam supplied to the steam turbine is raised by heat exchange with the combustion gases exhausted from the turbo-expander. The oxygen product compressor, the air compressor of the air separation plant, the steam turbine and the turbo-compressor are all coupled together. Such a plant cannot produce nitrogen in large quantities.

The largest plants may produce up to 10,000 tonnes per day of product nitrogen at elevated pressure. Accordingly, large product nitrogen compressors are required. Conventionally, such compressors are driven by electrical motors. The electrical motors are often large and problems can arise in starting up the motors. Typically additional start-up motors are provided.

It is the aim of the present invention to provide an air separation plant which does not require an electrical motor for the purposes of driving a product nitrogen compressor.

SUMMARY OF THE INVENTION

According to the present invention there is provided an air separation plant including a product nitrogen compressor, a gas turbine and a steam turbine, the gas turbine and the steam turbine being operatively associated with the product nitrogen compressor so as to drive the product nitrogen compressor, wherein the steam turbine has an inlet communicating with a steam generator adapted to recover heat from the gas turbine.

An air separation plant according to the invention offers a number of advantages. Firstly, the need for large electrical motors to drive the said compressor is obviated. Secondly, the steam is able to be raised in a cycle which can be operated more efficiently than if the steam is raised directly by burning a fuel. Thirdly, if the product nitrogen pressure is required to be changed over a period of time, driving the product nitrogen compressor by means of the steam turbine and the gas turbine provides more flexibility for adjusting the product pressure than in a comparable arrangement in which the product compressor is driven by an electric motor.

The invention also provides an air separation plant including an air compressor, a first gas turbine, a first steam turbine, a product nitrogen compressor, a second gas turbine and a second steam turbine, the air compressor being operatively associated with the first gas turbine and the first steam turbine, and the product nitrogen compressor being operatively associated with the second gas turbine and the second steam turbine, wherein the first and second steam turbines each have an inlet communicating with, respectively, a first steam generator and a second steam generator, the first steam generator being adapted to recover heat from the first gas turbine, and the second steam generator being adapted to recover heat from the second gas turbine.

By arranging for both the air compressor and the product nitrogen compressor to be driven by means of a combination of a gas turbine and a steam turbine it is possible to eliminate large electrical motors from an air separation plant according to the invention.

If a site on which an air separation plant according to the invention is located has a mains electrical supply, this supply may be used to power any part of the air separation plant which is electrically driven, for example water pumps required to pressurise and feed water to steam generators in which steam is raised for expansion in the steam turbines. If such a mains electricity supply is not available, a suitable power station may be installed on site. If desired, the necessary electrical generator(s) may be driven by at least one further gas turbine. Alternatively, at least one steam turbine may be used. If desired, the air separation plant according to the invention may share a steam raising facility with the steam turbine(s) that drive the electrical generator (s). If such an arrangement is adopted, the steam raising facility preferably includes a start-up boiler to initiate raising of steam. Once the steam generators adapted to recover heat from hot gaseous exhaust from the gas turbines associated with the compressors are operating normally, operation of the start-up boiler may be discontinued.

An air separation plant according to the invention typically additionally includes adsorption apparatus for removing water vapour and carbon dioxide from the compressed air, a heat exchanger for reducing air to a temperature at which it is able to be separated by rectification, at least one rectification column for separating nitrogen from the air, and at least one turbo-expander for generating refrigeration. Preferably, the rectification column is a double rectification column comprising a higher pressure stage, a lower pressure stage and a condenser-reboiler thermally linking an upper region of the higher pressure stage to a lower region of the lower pressure stage, the arrangement being such that, in operation, the condenser provides reflux for both stages of the double rectification column. If desired, in order to maximise the average pressure at which nitrogen is taken from the rectification column, a stream of gaseous nitrogen may be taken from both the lower pressure stage and the higher pressure stage. In order to enhance the rate at which reflux is produced, part of the nitrogen vapour taken from the lower pressure stage may be condensed and fed back to the lower pressure stage. Necessary cooling for the additional condensation may be provided by taking a stream of oxygen-enriched liquid from the bottom of the lower pressure stage, reducing its pressure and thereby reducing its temperature, and heat exchanging the reduced pressure oxygen-enriched liquid stream with the nitrogen to be condensed.

BRIEF DESCRIPTION OF THE DRAWINGS

Air separation plants according to the invention will now be described by way of example with reference to the accompanying drawings, in which.

Like parts in the FIGS. are identified by the same reference numerals.

DETAILED DESCRIPTION OF THE INVENTION

Figure 1:
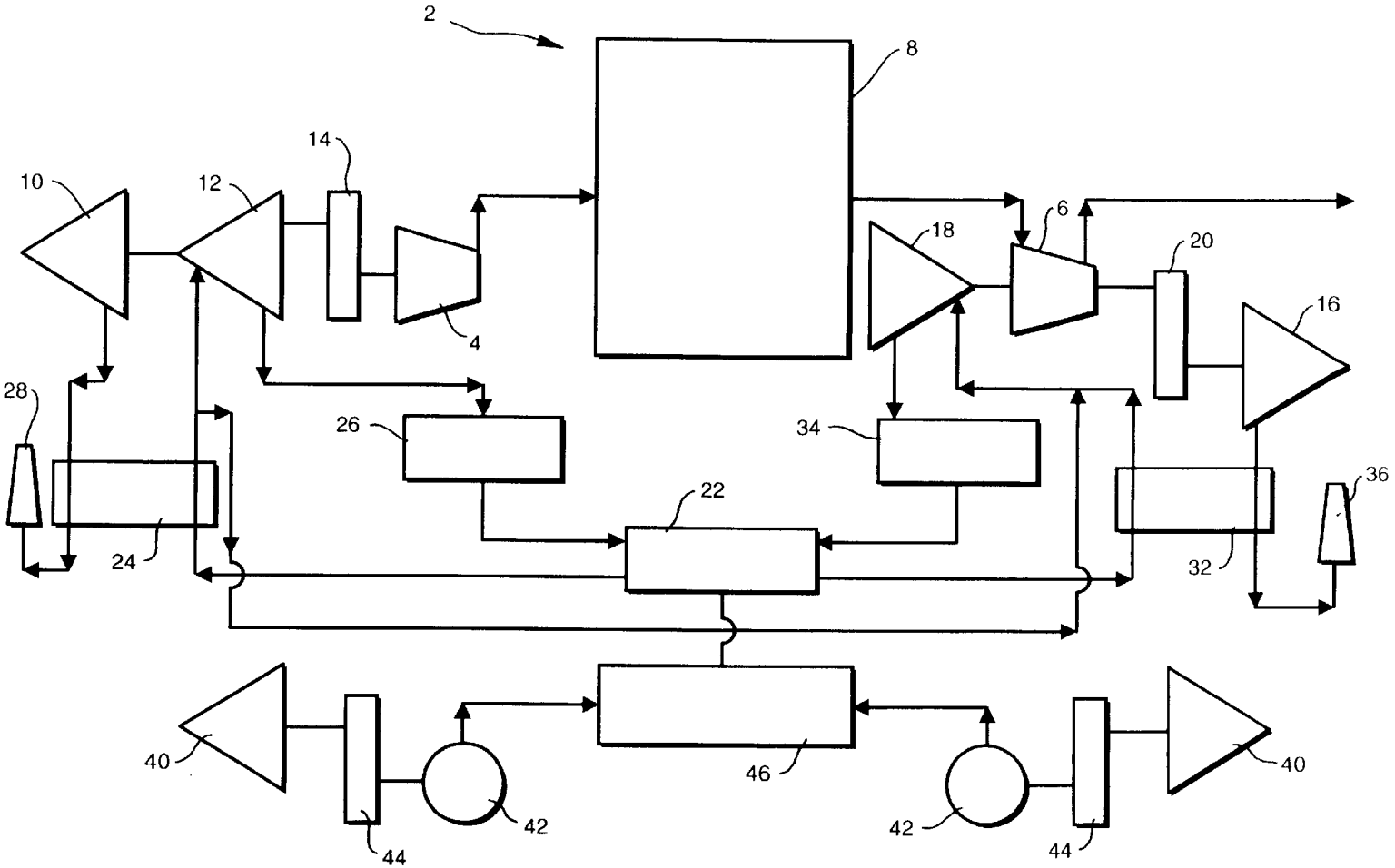
FIG. 1 is a schematic flow diagram of the first air separation plant and associated power generation plant.

Referring to FIG. 1 of the drawings there is shown an air separation plant 2 of the separation of air by rectification. The plant 2 is intended to provide a nitrogen product at elevated pressure. It includes a main air compressor 4, typically comprising a plurality of compression stages, and a nitrogen product compressor 6, also typically comprising a plurality of compression stages. The remaining components of the air separation plant 2 are indicated by the reference numeral 8. For ease of illustration, the remaining parts are represented by a rectangular symbol and need not be described further herein. They are all well known and the invention primarily concerns the operation of the compressors 4 and 6.

In normal operation the plant shown in FIG. 1, the air compressor 4 is driven by a first gas turbine 10 and a first steam turbine 12 through an arrangement of gears 14. The components of the gas turbine 10 are not shown in FIG. 1 but typically comprise a separate air compressor, a combustion chamber having an inlet for air from the separate air compressor and an inlet for fuel gas, and a turbo-expander for expanding the combustion product issuing from the combustion chamber. Typically, the separate air compressor forming part of the gas turbine 10, the turbo-expander forming part of the gas turbine 10, and the steam turbine 12 are all mounted on the same shaft. Alternative arrangements are, however, possible. For example, both the gas turbine and the steam turbine may be mounted on different shafts and may both drive the air compressor 4 through an arrangement of gears.

The product nitrogen compressor 6 is in normal operation driven by a second gas turbine 16 and a second steam turbine 18. As shown in FIG. 1, the second gas turbine 16 may provide its drive through an arrangement of gears 20 and the second steam turbine may be directly coupled to the nitrogen compressor 6. Alternative arrangements, are, however, possible. For example both turbines may be coupled to the nitrogen compressor 6 through an arrangement of gears.

The steam that is supplied to the first steam turbine 12 flows in a circuit including a vessel 22 containing water having an outlet communicating via a pump (not shown) with a steam generator 24 of a heat recovery kind. In operation, superheated, pressurised steam flows to the steam turbine 12 and is expanded therein. The expanded steam, flows to a water condenser 26 in which it is condensed and which feeds the condensed steam to the vessel 22. Superheated steam is raised in the steam generator 24 by heat exchange between hot exhaust gases from the turbo-expander of the gas turbine 12 and the pressurised water. The exhaust gases from the turbine are vented to the atmosphere via a stack 28 downstream of their passage through the steam generator 24. An advantage of employing both the gas turbine 10 and the steam turbine 12 to drive the air compressor 4 is that the size of the gas turbine 10 may be kept down.

The second steam turbine 18 operates in a circuit analogous to that of which the steam turbine 14 forms a part. Water is pumped under pressure from the vessel 22 to a second steam generator 32 of the heat recovery kind. Superheated steam is raised in the steam generator 32 and is supplied to the inlet to the steam turbine 18. Expanded steam passes out of the second steam turbine 18 and is condensed in a condenser 34. The resulting condensate is returned to the vessel 22. The steam is raised in the second steam generator 32 by heat exchange of the pressurised water with hot combustion gases exhausting from the turbo-expander of the second gas turbine 16. Downstream of the steam generator 32 the exhaust gases are vented to the via a stack 36.

Although the machines described above do not require any supply of electrical power to enable them to be driven, such a supply is typically required for the purposes of operating water pumps and for other auxiliary equipment. The apparatus shown in FIG. 1 may need to be operated on a site where there is no mains electricity supply. In order to generate the necessary electricity, a further gas turbine or gas turbines may be operated. As shown in FIG. 1 there are two further gas turbines 40. Each gas turbine 40 drives an electrical generator 42 through an arrangement of gears 44. The generators 42 supply electrical power to an electrical system 46 adapted to supply electricity to the pumps (not shown) and other auxiliary systems associated with the apparatus shown in FIG. 1 as well as for other uses. In particular, it may be required, in order to generate very large volumes of nitrogen for the enhanced recovery of oil, to operate a plurality of plants of the same kind as shown in the drawing. The gas turbines 40 may be used to supply electrical power to the pumps and other auxiliary parts of these other plants.

Various changes and modifications may be made to the plant in FIG. 1 of the drawings. For example, in the enhanced recovery of oil or gas it is typically desired to have a source of nitrogen available at a pressure in excess of 100 bar. Typically, to provide such a pressure a further plural stage nitrogen compressor (not shown) is used in series with the nitrogen compressor 6. The further nitrogen compressor may also be driven by the second gas turbine 16 and the second steam turbine 18 via a separate arrangement of gears (not shown). Alternatively, a combination of a further steam turbine (not shown) and a further gas turbine (not shown) may be provided for this purpose and may be fed with pressurised superheated steam.

Typically, nitrogen is supplied to the product nitrogen compressor 6 at an elevated pressure in the range of 3 to 6 bar from the air separation plant 2. If desired, a further nitrogen stream may be supplied to an intermediate stage of the nitrogen compressor 6 from the air separation plant 2 at a pressure in excess of 10 bar.

Figure 2:
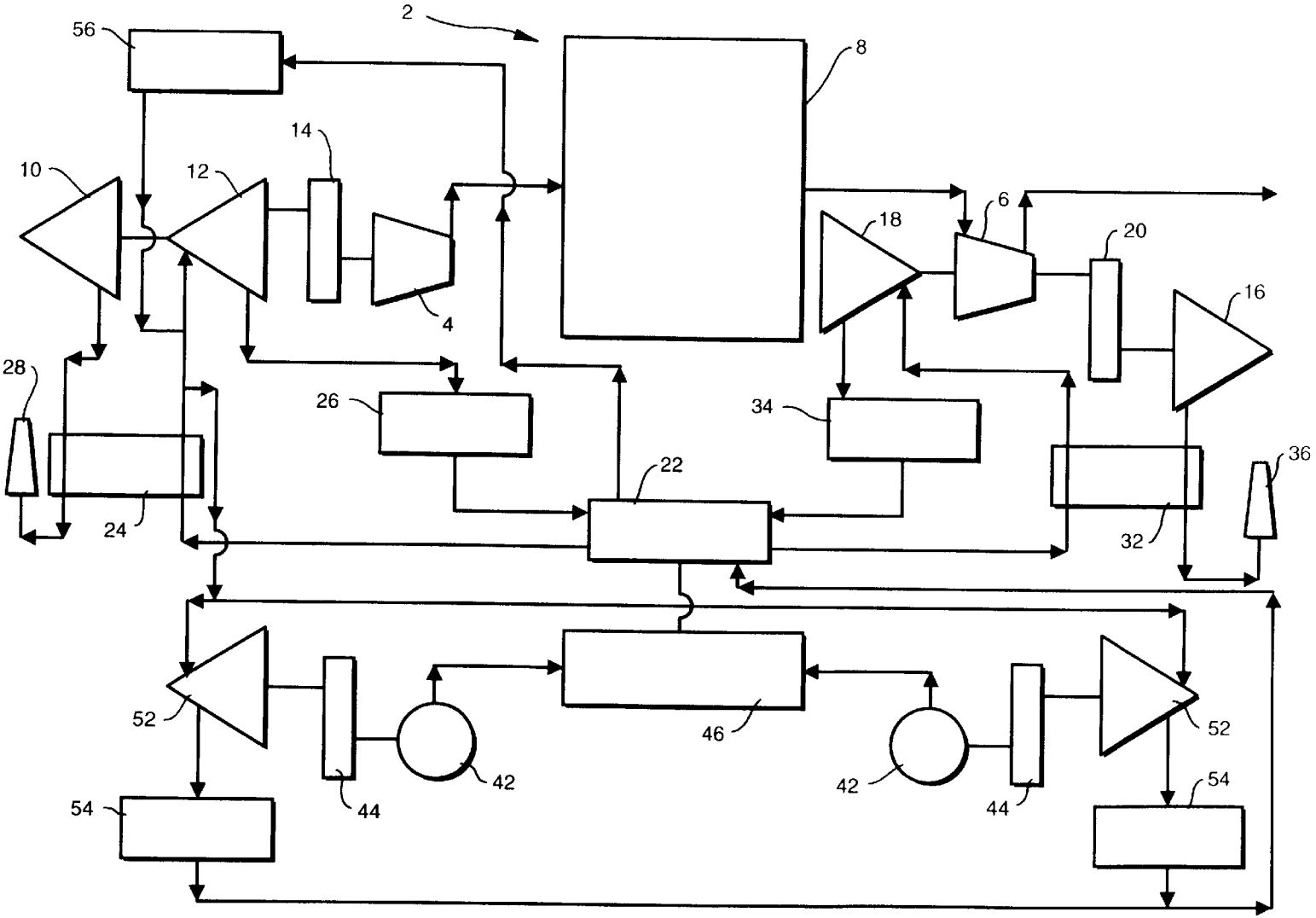
FIG. 2 is a schematic flow diagram of the second air separation plant and associated power generation plant. The drawings are not to scale.

Referring to FIG. 2 of the drawings, there is shown a modification to the plant illustrated in FIG. 1. In this modification, steam turbines 52 are substituted for the gas turbines 42 of FIG. 1. Each steam turbine 52 has a water condenser 54 associated therewith. Superheated steam at elevated pressure is fed to the steam turbines 52 from the steam generators 24 and 32.

Expanded steam from the steam turbines 52 is condensed in the condensers 54 and is returned to the vessel 22. In order to facilitate start-up of the plant, a start-up boiler 56 is provided. Typically, the start-up boiler 56 receives water from the vessel 22 and generates steam which is directed to the steam turbines 52. This enables electrical power to be generated and supplied to the pumps (not shown) in the main steam raising circuits. Operation of the gas turbines 10 and 16 can then be initiated. Heat is recovered from the hot gases exhausting from these turbines so as to enable sufficient steam to be raised to start operation of the steam turbines 12 and 18. Once the steam turbines 12 and 18 are fully operational, the start-up boiler may be shut down.

Typically an auxiliary electrical pump will be used to supply the start-up boiler 56 with water from the vessel 22. Since electrical power will not be available instantaneously from the generators 42. A preferred start-up procedure involves the use of a diesel generator (not shown) just for the purpose of operating the auxiliary electrical pump and any other apparatus in the start-up steam circuit requiring an electrical power supply. The diesel generator can be de-energised simultaneously with the shut down of the start-up boiler 56.

What is claimed is:

1. An apparatus for compressing nitrogen produced by an air separation plant including:

a product nitrogen compressor for compressing said nitrogen;

a gas turbine and a steam turbine;

the gas turbine and the steam turbine being operatively associated with the product nitrogen compressor so as to be able to drive the product nitrogen compressor and the steam turbine having an inlet communicating with a steam generator configured to recover heat from the gas turbine.

2. An apparatus for compressing nitrogen produced by an air separation plant including:

an air compressor;

a first gas turbine;

a first steam turbine;

a product nitrogen compressor;

a second gas turbine; and a second steam turbine;

the air compressor being operatively associated with the first gas turbine and the first steam turbine, and the product nitrogen compressor being operatively associated with the second gas turbine and the second steam turbine;

the first and second steam turbines each having an inlet communicating with, respectively a first steam generator and a second steam generator; and the first steam generator configured to receive heat from the first gas turbine;

and the second steam generator configured to receive heat from the second gas turbine.

3. The air separation plant as claimed in claim 2, additionally including at least one further gas turbine operatively associated with at least one electrical generator for supplying electrical power to the plant.

4. The air separation plant as claimed in claim 2, additionally including at least one further steam turbine operatively associated with at least one electrical generator for supplying electrical power to the plant.

5. The air separation plant as claimed in claim 4, in which the first and second steam generators are arranged so as to be able to supply steam to the further steam turbine.

6. The air separation plant as claimed in claim 5, additionally including a start-up boiler for raising steam to commence operation of the further steam turbine.

* * * * *